US007407088B2

(12) United States Patent
Hafkin et al.

(10) Patent No.: US 7,407,088 B2
(45) Date of Patent: Aug. 5, 2008

(54) ADAPTABLE FOOD STORAGE BOX

(76) Inventors: Amy Hafkin, 225 W. 109th St., #40, New York, NY (US) 10025; David Ashen, 400 Chambers St., Apt. 26A, New York, NY (US) 10232

( * ) Notice: Subject to any disclaimer, the term of this patent is extended or adjusted under 35 U.S.C. 154(b) by 0 days.

(21) Appl. No.: 11/743,282

(22) Filed: May 2, 2007

(65) Prior Publication Data

US 2008/0035716 A1 Feb. 14, 2008

Related U.S. Application Data

(60) Provisional application No. 60/872,427, filed on May 5, 2006.

(51) Int. Cl.
*B65D 5/10* (2006.01)
*B65D 5/28* (2006.01)
*B65D 5/54* (2006.01)

(52) U.S. Cl. ..... 229/101.2; 229/154; 229/155; 229/195; 229/196

(58) Field of Classification Search ..... 229/101.1, 229/101.2, 195, 196, 152, 154, 155
See application file for complete search history.

(56) References Cited

U.S. PATENT DOCUMENTS 2,251,565 A * 8/1941 Forman ..... 229/146
3,167,240 A * 1/1965 Collura et al. ..... 229/101.2
3,285,494 A * 11/1966 Baker ..... 229/154
3,310,220 A * 3/1967 Feldman ..... 229/101
3,327,922 A * 6/1967 Netherton et al. ..... 229/154
3,430,840 A 3/1969 Paige
3,690,544 A * 9/1972 Meyers ..... 229/101.2
4,406,380 A 9/1983 Paige
4,576,329 A 3/1986 Wright et al.
4,848,651 A 7/1989 Hartness
5,011,071 A 4/1991 Lopez
5,020,337 A 6/1991 Krieg
5,071,062 A * 12/1991 Bradley et al. ..... 229/109
5,762,262 A 6/1998 Martin
6,375,066 B1 * 4/2002 Ritter ..... 229/101.2
6,394,336 B1 5/2002 Beneroff et al.
6,440,050 B1 * 8/2002 Capparelli et al. ..... 493/59
7,051,919 B1 * 5/2006 Walsh ..... 229/103
7,059,494 B2 6/2006 Harrelson et al.

* cited by examiner

*Primary Examiner*—Gary E Elkins
(74) *Attorney, Agent, or Firm*—Gottlieb, Rackman & Reisman

(57) ABSTRACT

A cardboard blank for constructing a first larger size food storage box and also constructing a smaller size food storage box is provided. The blank includes a first plurality of panels foldably connected to one another along a plurality of primary fold lines in order to foldably construct the larger box, and further includes a series of tearable line elements for defining removable portions of the blank and a second smaller blank. The second smaller blank includes a second plurality of panels foldably connected to one another along a plurality of secondary fold lines in order to foldably construct the smaller box.

4 Claims, 6 Drawing Sheets

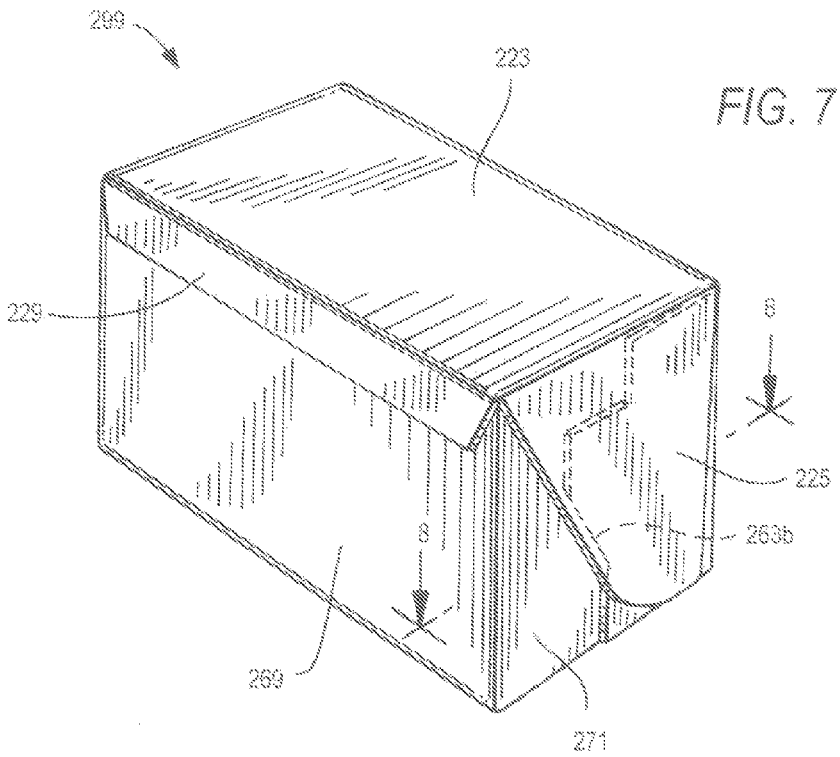
FIG. 7
FIG. 8
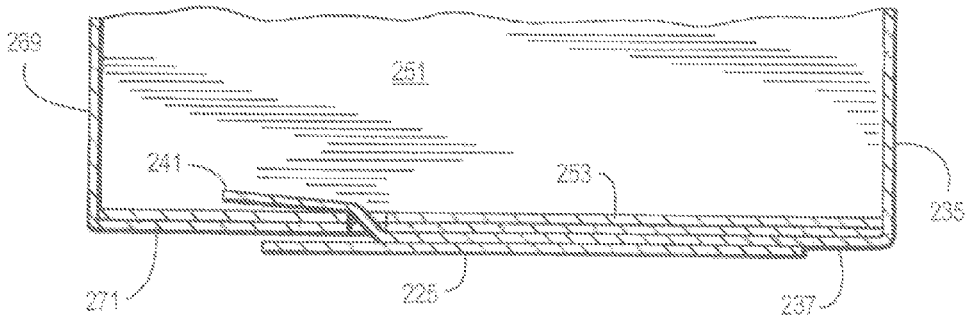

ADAPTABLE FOOD STORAGE BOX

BACKGROUND OF THE INVENTION

This application claims priority benefit of Provisional application Ser. No. 60/872,427, filed May 5, 2006 (having been converted from application Ser. No. 11/381,784.)

This invention relates to a cardboard box for use in food storage, and more particularly, to a single cardboard blank that is suitable for use in the construction of cardboard boxes of different sizes.

Cardboard boxes made from foldable cardboard blanks are well known for use in packaging food and other items, such as cakes, pizza, etc. The problem is when a portion of the food item is eaten and there is a need to retain the remaining left over portion in the box for later consumption. What happens presently is that there is now a box used for storing the remaining food that is substantially empty. This creates a storage problem, since one has to reuse the large box when storing the food item in a refrigerator or pantry, where space is often at a premium. And, while the supplier of the food could provide a second small box for food storage purposes, this is rarely done, and would otherwise increase costs and inconvenience.

Accordingly, it would be desirable to provide a foldable cardboard blank that can be constructed into different size boxes in order to also accommodate the storage of left-over food or other types of items without wasting unused space in the box.

SUMMARY OF THE INVENTION

Generally speaking, in accordance with the invention, a cardboard blank for constructing a first larger size box and also constructing a smaller size food storage box is provided. The blank includes a first plurality of panels foldably connected to one another along a plurality of primary fold lines in order to foldably construct the larger box. In addition, the blank includes a series of tearable line elements for defining removable portions of the blank and a second smaller blank. The second smaller blank includes a second plurality of panels foldably connected to one another along a plurality of secondary fold lines in order to foldably construct the second box.

In a preferred form, the cardboard blank can be foldably assembled into a larger cardboard box. The blank includes pre-scored or perforated fold lines such that, when portions of the blank are torn off along the score lines, the remaining smaller blank can be folded into a smaller version of the original box.

Accordingly, it is an object of the invention to provide an improved cardboard blank that is readily foldable from a flat condition to an erect condition in the form of a box.

It is another object of the invention to provide different size cardboard food storage boxes foldably constructed from the same cardboard blank.

A further object of the invention is to provide a box construction that can be made flat for sale and shipping purposes.

Yet another object of the invention is to provide a single cardboard blank that is suitable for use in constructing food storage boxes of different sizes in a simple and efficient manner.

Still other objects and advantages of the inventions will, in part, be obvious and will, in part, be apparent from the following description.

The invention accordingly comprises the several steps, and the relation of one or more such steps with respect to the others, and the article of manufacture possessing the features, properties and relation of elements which will be exemplified in the article hereinafter described, and the scope of the invention will be indicated in the claims.

BRIEF DESCRIPTION OF THE DRAWINGS

For a fuller understanding of the invention, reference is now made to the following drawings in which:

FIG. 7 is a perspective view of a fully assembled box made from the second blank shown in FIG. 5; and FIG. 8 is a cross-sectional view taken along line 8-8 of FIG. 7.

DETAILED DESCRIPTION OF A PREFERRED EMBODIMENT

Figure 1:
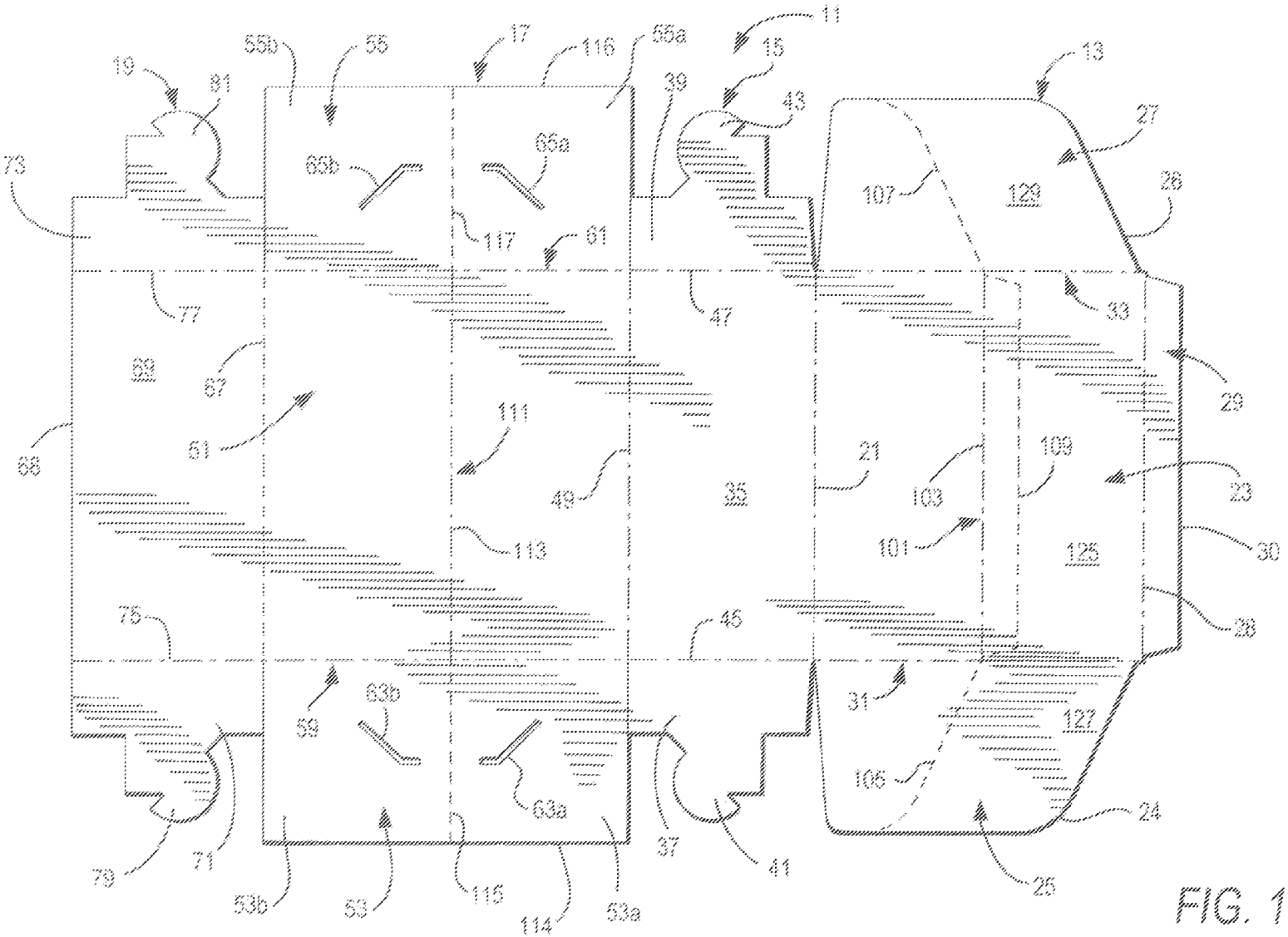
FIG. 1 is a top plan view of a cardboard blank used for making a large size food storage box in accordance with the invention.

Referring first to FIG. 1, a cardboard blank, made from a flexible foldable paper-like material and suitable for constructing a food storage box, is generally indicated at 11. Blank 11 includes a top panel 13, a rear panel 15, a bottom panel 17 and a front panel 19 (from right to left in FIG. 1). Top panel 13 is foldably connected to a back panel 15 along non-perforated fold line 21. Top panel 13 includes main panel element 23 and opposing side panel elements 25 and 27. Main panel element 23 is foldably connected to side panel element 25 along fold line 31, while main panel element 23 is foldably connected to side panel element 27 along fold line 33. Each of side panel elements 25 and 27 include an edge 24 and 26 respectively.

Main panel element 23 of top panel 13 is foldably connected to a flap panel 29 along fold line 28. Flap panel 29 defines a top edge 30.

Back panel 15 is foldably connected to bottom panel 17 along non-perforated fold line 49; it includes a main panel element 35 and side panel elements 37 and 39 foldably connected to main panel element 35 along fold lines 45 and 47 respectively. Each of the side panel elements 37 and 39 of back panel 15 include oppositely projecting tabs 41 and 43 respectively. Tabs 41 and 43 are designed to be releasably received in corresponding slots formed in bottom panel 17 when assembling the inventive box, as described below.

Bottom panel 17 is foldably connected to front panel 17 along perforated fold line 67; it includes a main panel element 51 and opposed side panel elements 53 and 55 foldably connected to main panel element 51 along fold lines 59 and 61 respectively. Side panel element 53 has a side edge 114 and is formed with a pair of slots or cuts 63*a* and 63*b* that are designed for releasably receiving corresponding tabs of back panel 15 and front panel 19. Similarly, side panel element 55 has a side edge 116 and is formed with a pair of slots or cuts

65*a* and 65*b* designed for releasably receiving corresponding tabs of back panel 15 and front panel 19.

Front panel 19 is foldably connected to bottom panel 15 and has a front edge 68; it includes a main panel element 69 and opposed side panel elements 71 and 73 foldably connected to main panel element 69 along fold lines 75 and 77 respectively. Each of side panel elements 71 and 73 includes oppositely projecting tabs 79 and 81 respectively. Tabs 79 and 81 are designed to be releasably received within corresponding cuts 63*b* and 65*b* of panel 17 during construction of the inventive box.

Top panel 13 has a width defined between non-perforated fold line 21 and fold line 28. Rear panel 15 has a width running between fold lines 49 and 21. Bottom panel 17 has a width running between perforated fold line 67 and non-perforated fold line 49. Finally, front panel 19 has a width running between front edge 68 and fold line 67.

Preferably, the width of top panel 13 is substantially equal to the width of bottom panel 17, while the width of back panel 15 is substantially equal to the width of front panel 19. In addition, the width of top panel 13 is twice that of back panel 15 and of front panel 19, and the width of bottom panel 17 is also twice that of back panel 15 and front panel 19.

Side panel element 53 of bottom panel 17 has a depth running between fold line 59 and side edge 114. Side panel element 55 of bottom panel 17 has a depth running between fold line 61 and side edge 116. The depth of each of side panel elements 53 and 55 is substantially equal to the width of back panel 15 as well as to the width of front panel 19.

Figure 2:
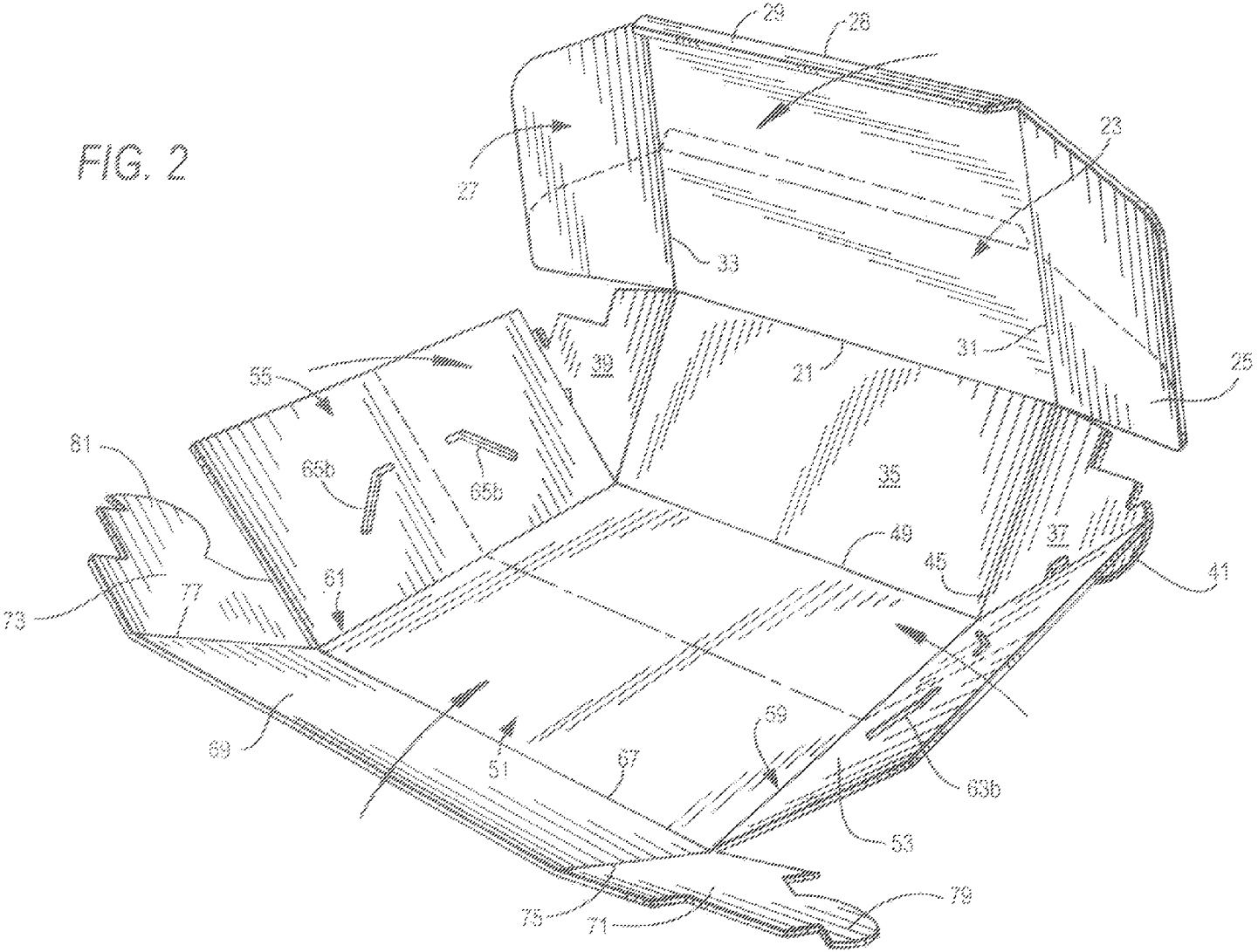
FIG. 2 is a perspective view of the blank shown in FIG. 1 being assembled into a food storage box.

As shown in FIG. 2, blank 11 is folded along its various fold lines in order to construct the inventive box. Specifically, side panel elements 53 and 55 of bottom panel 17 are folded inwardly along fold lines 59 and 61 respectively, so that they are at a right angle with respect to main panel element 51. Then, main panel element 69 of front panel 19 is folded upwardly along fold line 67. Side panel elements 71 and 73 of front panel 19 are now folded inwardly so that they are at substantially right angles with respect to main panel element 69. This enables tabs 79 and 81 of front panel 19 to lockingly engage cuts 63*b* and 65*b* respectively of bottom panel 17 (see FIG. 4).

Continuing with FIG. 2, after locking tabs 79 and 81 of front panel 19 in cuts 63*b* and 65*b* of bottom panel 17, main panel element 35 of back panel 15 is folded upwardly along fold line 49. Then, side panels 37 and 39 of back panel 15 are folded inwardly along fold lines 45 and 47 respectively so that tabs 41 and 43 of back panel 15 can lockingly engage cuts 63*a* and 65*a* of bottom panel 17 (see FIG. 4).

Figure 3:
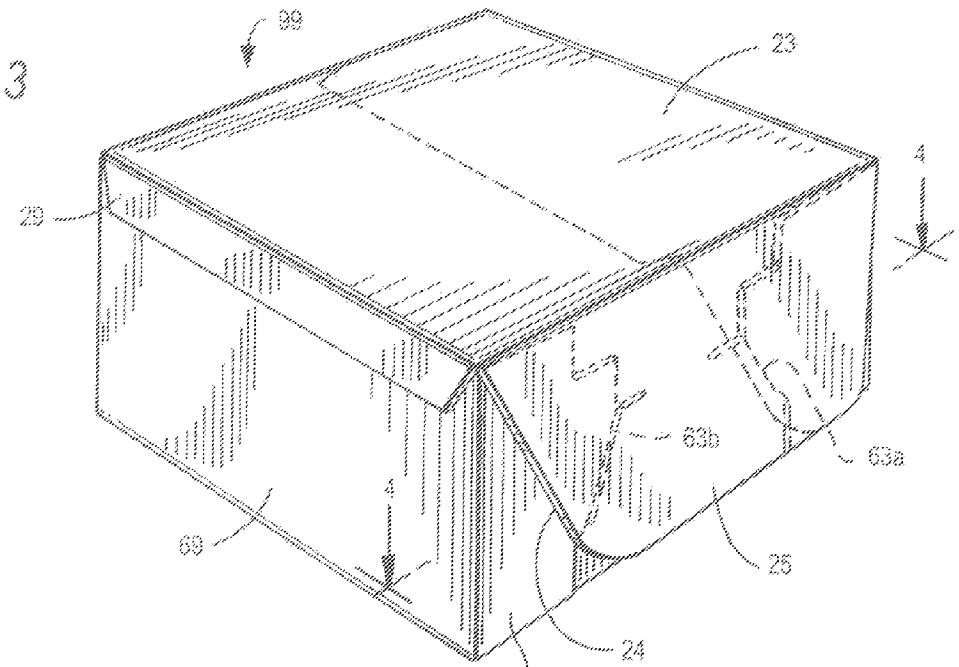
FIG. 3 is a perspective view of a fully assembled box made from the blank shown in FIG. 1.
Figure 4:
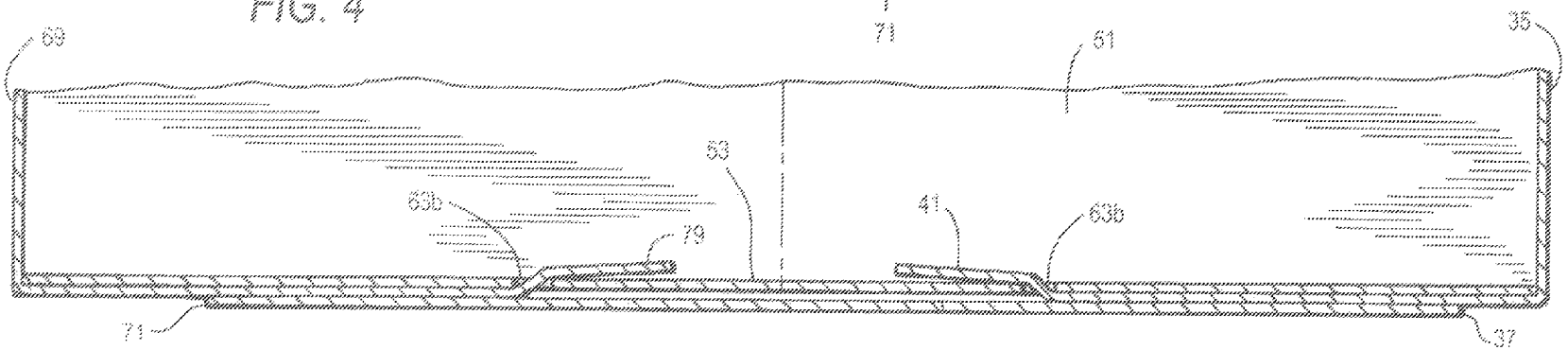
FIG. 4 is a cross-sectional view taken along line 4-4 of FIG. 3.

Top panel 13 is now closed over the remaining panels in order to form a box in accordance with the invention. In particular, main panel element 23 of top panel 13 is folded up along fold line 21 and positioned over and above main panel element 51 of bottom panel 17. Then, side panel elements 25 and 27 of top panel 13 are folded downwardly along fold lines 33 and 31 respectively, so as to be disposed over side panel elements 53 and 55 respectively of bottom panel 17 (see FIG. 4). Flap panel 29 is now folded down along fold line 28 so that it wraps over the top longitudinal edge of main panel element 69. As a result, a first larger box 99 is produced, as shown in FIGS. 3 and 4.

Turning again to FIG. 1, blank 11 is shown formed with a series of perforated and non-perforated fold lines so that a second smaller blank can be cut out and used in foldably constructing a smaller size box. Particularly, top panel 13 is formed with a fold line 101 running from edge 24 of side panel element 25 to edge 26 of side panel element 27. Fold line 101 includes an intermediate non-perforated foldable line segment 103 running between fold lines 31 and 33, as well as perforated line segments 105 and 107 running between fold lines 31 and 33, respectively, and edges 24 and 26 of side panels 25 and 27.

Significantly, perforated line segments 105 and 107 run substantially parallel to the front portions of edges 24 and 26 of side panel elements 25 and 27. Moreover, the distance between fold line 21 and line segment 103 of fold line 101 is substantially one-half of the width of top panel 13, as defined previously.

Main panel element 23 of top panel 13 also includes a perforated fold line 109 running between fold lines 33 and 31. Perforated fold line 109 is, for the most part, spaced from and parallel to non-perforated line segment 103 of fold line 101 and defines a tearable front panel member 125. Similarly, perforated line segments 105 and 107 of fold line 101 define tearable side panel members 127 and 129.

Still referring to FIG. 1, bottom panel 17 is shown formed with a longitudinally extending fold line 111 running between side edge 114 and side edge 116. Fold line 111 divides bottom panel 17 substantially in half; in other words, the width of bottom panel 17, as defined previously, is substantially twice that of the distance between perforated fold line 67 and fold line 111 as well as of the distance between fold lines 49 and fold line 111. Fold line 111 includes a non-perforated foldable line segment 113 running between fold lines 59 and 61, as well as perforated line segments 115 and 117. Perforated line segment 115 runs between fold line 59 and side edge 114, while perforated line segment 117 runs between fold line 61 and side edge 116.

Figure 5:
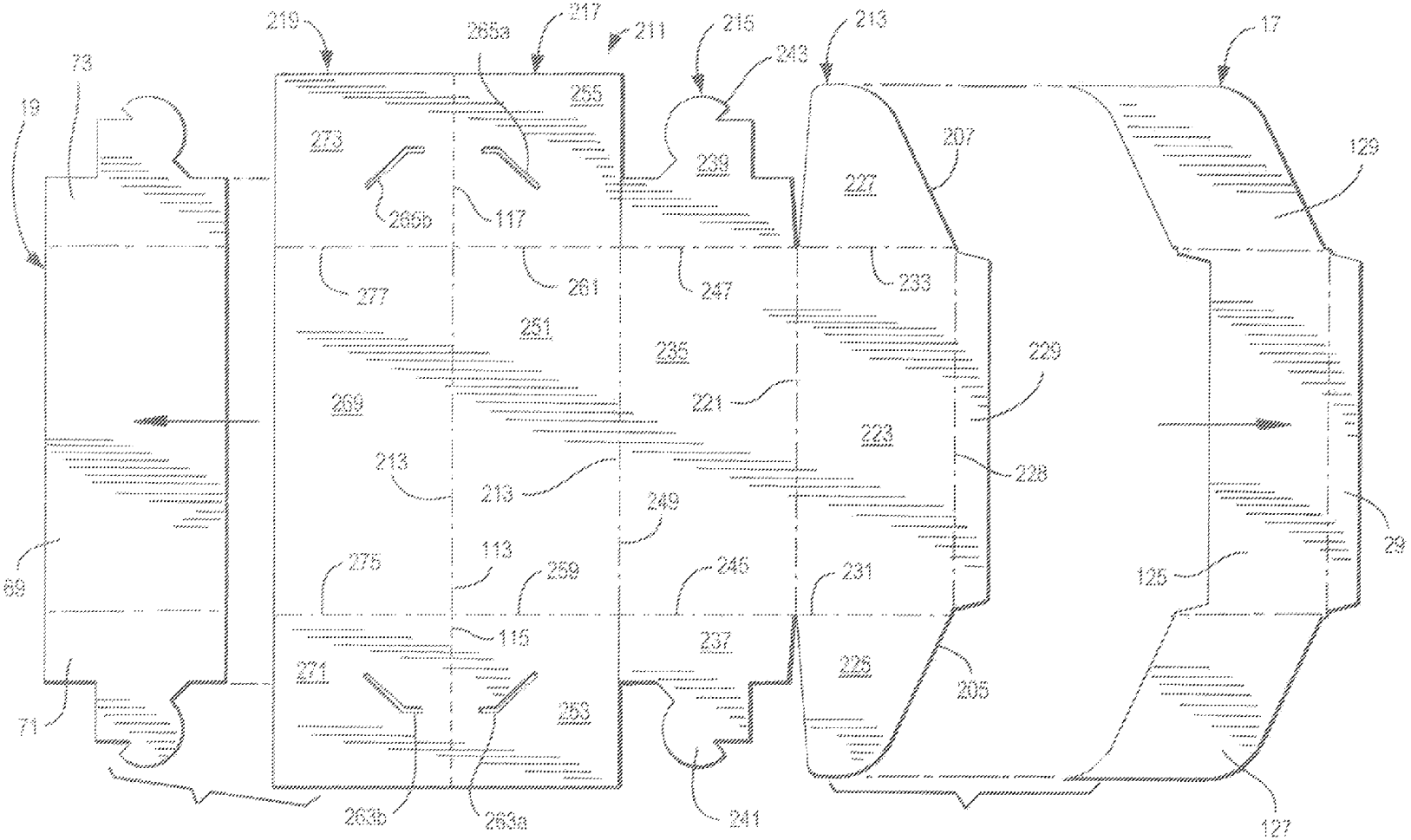
FIG. 5 is an exploded top plan view showing portions of the blank depicted in FIG. 1 being torn away in order to produce a second cardboard blank used for making a smaller size food storage box in accordance with the invention.

In order to construct a second blank for a smaller size box, and as shown in FIGS. 1 and 5, the following steps are carried out. First, front panel 19 is completely removed from blank 11 by tearing along perforated fold line 67. Then, perforated line segment 115 is torn therealong in order to divide side panel element 53 of bottom panel 117 into side panel members 53*a* and 53*b*. Similarly, perforated line segment 117 of fold line 111 is torn therealong in order to divide side panel element 55 into side panel members 55*a* and 55*b*. Then, top panel 13 is torn along perforated line segments 105 and 107 of fold line 101 and along perforated fold line 109. This enables the removal of the portion 97 of top panel 13 defined be tearable panel members 125, 127 and 129.

As a result, and referring still to FIG. 5, separable panels to either side of blank 11 are thus torn away and removed, thereby producing a blank 221 that is suitable for use in assembling a second smaller box.

As depicted in FIG. 5, blank 221 includes a top panel 213, a back panel 215, a bottom panel 217 and a front panel 219. It is noted that bottom panel 17 of blank 11 (see FIG. 1) now defines bottom panel 217 and front panel 219 of blank 221. In addition, back panel 15 of blank 11 (see FIG. 1) is the same as back panel 215 of blank 221. Moreover, portion 97 of top panel 13 of blank 11 has been cut away or otherwise removed in order to define top panel 213 of blank 221.

Top panel 214 is foldably connected to rear panel 215 along fold line 221 and includes a main panel element 223 and opposing side panel elements 225 and 227. Side panel elements 225 and 227 have edges 205 and 207. Side panel element 225 is foldably connected to main panel element 223 along fold line 231. Side panel element 227 is foldably connected to main panel element 223 along fold line 233. Main panel element 223 of top panel 213 is foldably connected to a flap panel 229 along fold line 228.

Back panel 215 is foldably connected to bottom panel 217 along fold line 249 and includes main panel element 235 and opposing side panel elements 237 and 239. Side panel element 237 is formed with a tab 241 and is foldably connected to main panel element 235 along fold line 245. Side panel element 239 is formed with a tab 243 and is foldably connected to main panel element 235 along fold line 247.

Bottom panel 217 is foldably connected to front panel 219 along fold line 213, and includes a main panel element 251 and opposed side panel elements 253 and 255. Side panel element 253 includes cut 263*a* and is foldably connected to main panel element 251 along fold line 259. Side panel element 255 includes cut 265*a*, and is foldably connected to main panel element 251 along fold line 261.

Front panel 219 includes a main panel element 269 and opposed side panel elements 271 and 273. Side panel element 271 includes cut 263*b* and is foldably connected to main panel element 269 along fold line 275. Side panel element 273 includes cut 265*b*, and is foldably connected to main panel element 269 along fold line 277.

Figure 6:
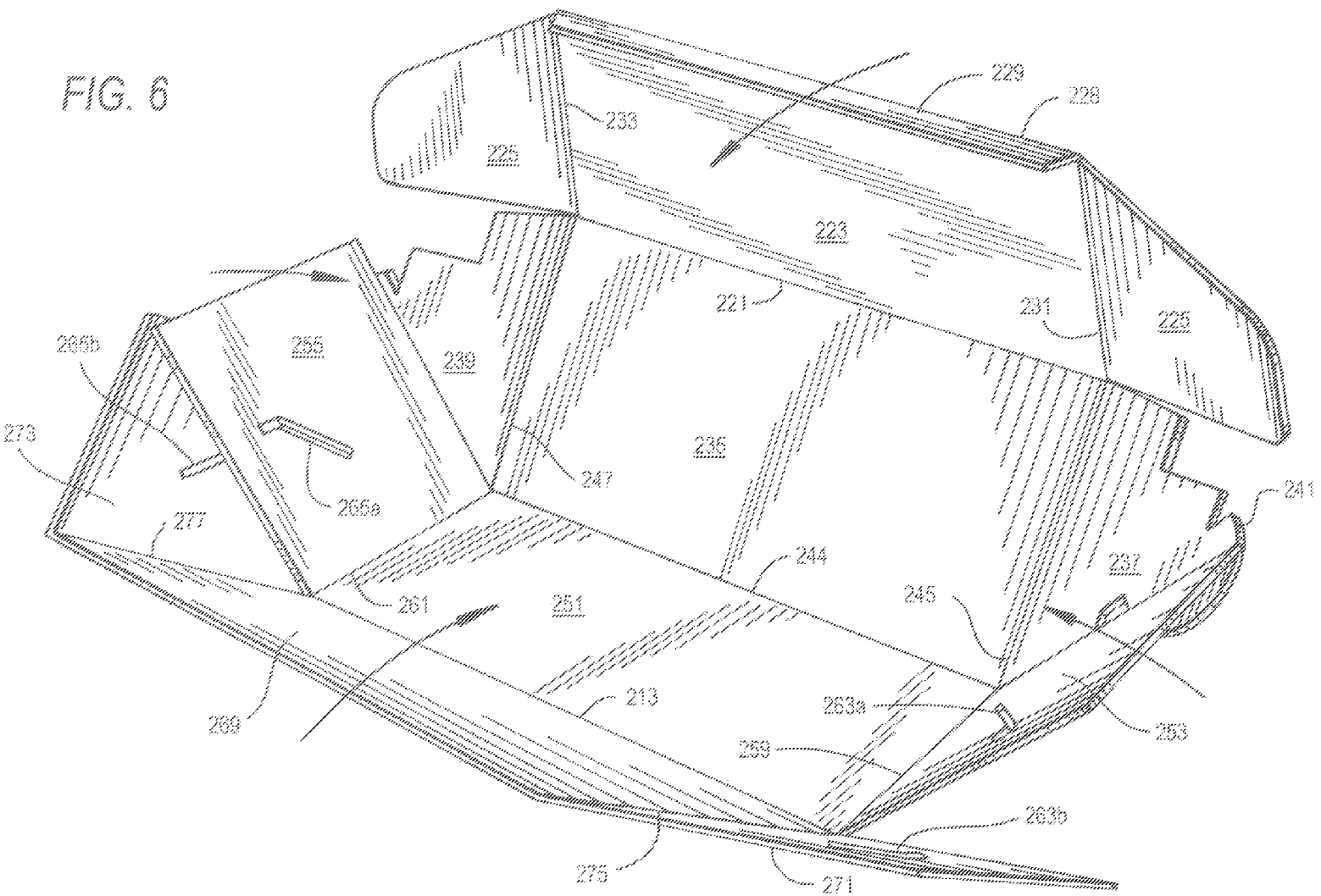
FIG. 6 is a perspective view of the second cardboard blank shown in FIG. 5 being assembled into a second food storage box.

In order to construct a box from blank 211, and as shown in FIG. 6, side panel elements 253 and 255 of bottom panel 217 are folded inwardly at substantially right angles along fold lines 259 and 261 respectively. Then, main panel element 269 of front panel 219 is folded upwardly at a right angle along fold line 213, followed by side panel elements 271 and 273 being folded inwardly at right angles along the fold lines 275 and 277 respectively, so that side panel elements 253 and 271, as well as side panel elements 255 and 273, are aligned with one another with cuts 263*a* and 263*b*, as well as cuts 265*a* and 265*b*, being in overlying alignment.

Then, main panel element 235 of back panel element 215 is folded upwardly along fold line 249, followed by side panel elements 237 and 239 being folded inwardly at right angles along fold lines 245 and 247 respectively, so that they can slide alongside aligned panels 253 and 271 and aligned panels 255 and 273. In this position, tabs 241 and 243 of side panel elements 237 and 239 can be selectively received within aligned cuts 263*a*, 263*b* and 265*a*, 265*b* in order to lock back panel 215 in position (see FIG. 8).

Thereafter, top panel 213 is folded down along fold line 221 so that main panel element 223 sits above main panel element 251 of bottom panel 217. Then, each of side panel elements 225 and 227 of top panel 214 are folded along fold lines 231 and 233 and placed along side panel elements 237 and 239 of back panel 215. Finally, flap panel 229 is folded down along fold line 228 and disposed along the upper longitudinal portion of main panel element 269 of front panel 219. A smaller box 299 is thus produced, as depicted in FIGS. 7 and 8.

The scope of the invention will now be set fort in the following claims.

The invention claimed is:

1. A cardboard blank for constructing a first larger size box and a second smaller size box, the blank comprising:

a first main panel with a first lateral side element having a first tab;

a second main panel separated from said first main panel by a tear/fold line and having a respective second lateral side element including a first slot and a second slot, said second main panel being formed with a first secondary fold line passing through said second main panel and said second lateral side element, said first secondary fold line being tearable along said second lateral side element between said first slot and said second slot;

a third main panel separated from said second main panel by a first main fold line and having a third lateral side element having a second tab; and a fourth main panel separated from said third main panel by a second main fold line and being formed with a tear line, said main fold lines, said fold/tear line and said secondary fold line being disposed in parallel;

wherein said first, second, third and fourth main panels being foldable along said tear/fold line, said first and said second main fold lines, respectively, to form a first parallelipipedal box with said first tab engaging said second lateral side element through said first slot and said second tab engaging said second lateral side element through said second slot; and wherein said first panel is tearable along said tear/fold line and a portion of said fourth panel is tearable along said tear line, and said second lateral side element being tearable along said first secondary fold line with the remaining panels and portions thereof being foldable to form a second parallelipipedal box with said first and second slots overlapping to form an opening and with said second tab engaging said opening formed by said slots.

2. The cardboard blank of claim 1 further comprising another first tab disposed opposite of said first tab of said first lateral side element, another first slot and another second slot disposed opposite of said first slot and second slot of said second lateral side element, and another second tab disposed opposite of said second tab of said third lateral side element.

3. The cardboard blank of claim 1 further comprising a foldable first flap connected to a portion of said fourth main panel to form said first parallelipipedal.

4. The cardboard blank of claim 1 further comprising two flaps being formed when said second lateral side element is torn along said first secondary fold line to form said second parallelipipedal box.

* * * * *